United States Patent [19]

Russell

[11] Patent Number: 4,467,782

[45] Date of Patent: Aug. 28, 1984

[54] VENTILATING SYSTEM FOR USE WITH DEVICES WHICH PRODUCE AIRBORNE IMPURITIES

[76] Inventor: Robert E. Russell, 2712 Landers Ave., Nashville, Tenn. 37211

[21] Appl. No.: 294,357

[22] Filed: Aug. 19, 1981

[51] Int. Cl.[3] ..... F24C 15/20

[52] U.S. Cl. ..... 126/299 D

[58] Field of Search ..... 55/DIG. 36; 98/115 R, 98/115 LH; 126/299 R, 299 D, 299 C

[56] References Cited

U.S. PATENT DOCUMENTS

| | | | |
|---|---|---|---|
| 3,285,154 | 11/1966 | De Rosa | 126/299 D |
| 3,400,649 | 9/1968 | Jensen | 126/299 D |
| 3,616,744 | 11/1971 | Jensen | 126/299 D |
| 4,043,319 | 8/1977 | Jensen | 126/299 D |
| 4,047,519 | 9/1977 | Hett | 126/299 D |
| 4,089,327 | 5/1978 | Welsh | 126/299 D |
| 4,127,106 | 11/1978 | Jensen | 126/299 D |
| 4,143,645 | 3/1979 | Blumberg | 126/299 D |
| 4,146,017 | 3/1979 | Overton, Jr. | 126/299 D |
| 4,155,348 | 5/1979 | Ahlrich | 126/299 D |
| 4,200,087 | 4/1980 | Welsh | 126/299 R |

*Primary Examiner*—Harold Joyce

*Attorney, Agent, or Firm*—Victor J. Evans & Co.

[57] ABSTRACT

A ventilation system for use with devices which produce airborne impurities, particularly cooking grills, deep fat fryers and the like. A first blower supplies untempered makeup air. A first plenum, which includes a first perforated wall having a plurality of openings therein, supplies air from the first blower, via a duct, into space beneath an upper front portion of a hood. A second plenum, which includes a second perforated wall having a plurality of apertures therein, supplies air from the first blower, via a duct, into space beneath the hood to cool air and impurities, which may include flue gas, moving upwardly in space adjacent the second perforated wall, the apertures in the second perforated wall being positioned to discharge air substantially horizontally into this space. A second blower is provided for exhausting air and impurities from the hood via a duct and an exhaust plenum. One or more filters are arranged opposite the first perforated wall and the exhaust plenum to remove grease from the exhaust. At least one opening, preferably one or more slots, extend along a member defining a wall portion of the exhaust plenum adjacent the top of the second perforated wall to effect passing into the exhaust plenum of air, impurities and flue gas moving upwardly along this wall.

7 Claims, 2 Drawing Figures

45'
15
16
14
46
47
12
48
13
18
17
11
20
22
21
34'
25
24
33
40
41
36
35
38
26
30
42
37
28
46
44
27
32
31
23
35
34
49
50
10

VENTILATING SYSTEM FOR USE WITH DEVICES WHICH PRODUCE AIRBORNE IMPURITIES

BACKGROUND OF THE INVENTION

This invention relates to a ventilation system for use with devices which produce airborne impurities, such as cooking grills, deep fat fryers and the like. More particularly, the invention relates to such a system which includes a hood which is to be disposed over a device which produces airborne impurities and is operatively associated with blowers for respectively supplying untempered air to space beneath the hood and for exhausting air, airborne impurities and possibly flue gas from the space beneath the hood.

For many years, various systems have been provided for exhausting air and airborne impurities, including flue gas if present, from the upper surfaces of cooking grills, deep fat fryers and the like. These known, conventional exhaust systems have two distinct shortcomings. Firstly, these early exhaust systems had low energy efficiencies because the tempered air, whether heated or air-conditioned, was constantly being removed from the premises in question and often exhausted to the outside of the building in which the premises were located. Secondly, the air being exhausted, with its airborne impurities which may and often did include grease particles and the like, remained very hot and could not be effectively captured by filters positioned in the exhaust path of the material, the fat and grease often accumulating to a hazardous degree on the walls of ducts of the exhaust system.

Ventilating systems have been proposed which utilize untempered, makeup air to remove objectionable fumes, vapors and the like emitted from a localized zone such as space above cooking ranges and the like. The untempered, makeup air is supplied to a localized zone over the cooking device or the like which reduces to a considerable degree the amount of ambient air surrounding the localized zone which would otherwise be required for exhaust. One such known system provides for an air discharge aperture rearwardly adjacent to a cooking range or the like, this single, upwardly facing aperture directing a relatively high velocity, low pressure, untempered air stream upwardly into an exhaust stack positioned above the cooking unit so as to draw airborne impurities from the localized zone. Some of the untempered, makeup air in this known system is fed beneath a support for the cooking unit, with the circulation of this makeup air extending along the front of the cooking unit into the exhaust system, which can include a filter or filters for capturing condensed grease vapors and the like from the air passing therethrough. An example of this known type of ventilation system is disclosed in U.S. Pat. No. 3,400,649 entitled "Ventilating System Including Fume Removal Means" and issued to Donald D. Jensen on Sept. 10, 1968. The energy efficiency of the exhaust system was improved to a considerable degree, nevertheless distinct disadvantages still were present. Grease and fat particles carried by the air being exhausted were often insufficiently cooled to be captured by the filter, with the result that the grease or fat often built up on the interior of ducts associated with the exhaust system. Furthermore, no effective means were provided for exhausting flue gas which, if present, would serve to detract from the cooling effect of the makeup air upon the airborne materials, such as grease.

Ventilating and exhaust systems are known which include a hood in operative association with a first plenum which includes upwardly facing apertures which extend along a surface adjacent to a rear edge of a cooking surface for supplying untempered, makeup air to space between the cooking surface and a hood along the back inner wall of the hood with the air exiting these apertures carrying air with its entrained impurities such as grease, upwardly to a filter positioned within the hood. A second plenum is operatively arranged along a front edge of the hood, a plurality of louvers or a slot being provided for directing untempered, makeup air from the front plenum into the upper portion of the space beneath the hood. Exhaust and ventilating systems of this known type have been disclosed, for example, in U.S. Pat. No. 4,043,319 entitled "Exhaust Hood" and issued to Donald D. Jensen on Aug. 23, 1977 and in U.S. Pat. No. 4,089,327 entitled "Kitchen Exhaust System" and issued to Clarke T. Welsh on May 16, 1978. It is believed that the ratio of untempered, makeup air to ambient air around the cooking unit which is exhausted is improved by these known systems. Nevertheless, systems of this known type have no provision for intensively cooling the air with its entrained impurities, such as grease, rising from the cooking surface especially near the back edge of the cooking surface. No provisions are made to reduce the heating effect of flue gas. Moreover, all of the air with airborne impurities must be exhausted from beneath the hood through the filter or filters provided between an exhaust plenum and the space beneath the hood.

A ventilator for cooking units having a forwardly disposed cooking area and a rearwardly disposed, upstanding flue provided for exhausting combustion products is known. The ventilator includes a free standing floor-supported hood of box-like shape which opens forwardly and downwardly to receive a cooking unit. A hood is formed by the box like inner and outer shells so as to define a single continuous air flow space. A pair of flow directing louvers extend along forward edges of the hood so as to supply makeup to the cooking area, which makeup air picks up air with the airborne impurities, such as grease, appearing over the cooking surface of the cooking unit and under the control of an exhaust suction fan effects the passage of such air with its airborne impurities through a filter or filters into an exhaust plenum. The flue is positioned adjacent a rear wall of the hood and extends upwardly along the rear wall to a point rearward of the filter or filters. A passageway is provided between space adjacent the flue and the interior of the exhaust plenum, a damper being provided within the passageway to control the exiting of flue gas. No provision is made for cooling the flue gases, which are believed to effect a heating of the filter or filters by virtue of the uncooled flue gases being present in the exhaust plenum, a distinct disadvantage. Moreover, because of the presence of an upstanding exhaust stack for the flue gases adjacent the rear wall of the hood, untempered makeup air cannot be injected into the space between the hood and the cooking surface from the rear wall, another distinct disadvantage and shortcoming.

As illustrations of the general prior art relating to ventilation and exhaust systems which can be advantageously associated with cooking units and the like, the following U.S. patents are of general interest:

| | | |
|---|---|---|
| No. 3,260,189 | D. D. Jensen | July 12, 1966, |
| No. 3,292,525 | D. D. Jensen | Dec. 20, 1966, |
| No. 3,386,365 | D. D. Jensen | June 4, 1968, |
| No. 3,616,744 | D. D. Jensen | Nov. 2, 1971, |
| No. 3,813,856 | D. D. Jensen | June 4, 1974 |
| No. 4,143,645 | S. Blumberg | Mar. 13, 1979 and |
| No. 4,200,087 | C. T. Welsh | Apr. 29, 1980. |

SUMMARY OF THE INVENTION

A primary object of the present invention is to provide a ventilation system which is of high energy efficiency for use with a device which produces airborne impurities, such as a cooking grill, deep fat fryer and the like.

Another object of the present invention is to provide a ventilation system which is able to cool air and airborne impurities being exhausted for use with a device which produces airborne impurities such as a cooking grill, deep fat fryer and the like.

An additional object of the present invention is to provide a ventialtion system which includes perforated walls for introducing untempered, makeup air into space beneath the hood for use with a device which produces airborne impurities, such as a cooking grill, deep fat fryer and the like.

Yet another object of the present invention is to provide a ventilation system which is especially adapted to provide cooling of hot gases, such as flue gases or hot air containing airborne impurities moving upwardly along a rear wall which is to be placed adjacent to a device which produces airborne impurities, such as a cooking grill, deep fat fryer and the like.

The foregoing objects, as well as others which are to become clear from the text below, are achieved by providing a ventilation system which includes a hood disposable over a device which produces airborne impurities. A first blower is provided for supplying untempered makeup air. A first plenum, having a first perforated wall with a plurality of openings therein is operatively arranged to be in communication with the first blower and defines a front, makeup air chamber. The front, makeup air chamber is positioned for discharging untempered makeup air into space beneath an upper front portion of the hood. A second plenum, which includes a second perforated wall having a plurality of apertures therein is arranged to be in communication with the first blower and defines a back, makeup air chamber. The back, makeup air chamber is operatively positioned to discharge untempered air into space beneath the hood and to cool air and impurities moving upwardly in space adjacent the second perforated wall, the apertures in the second perforated wall being positioned to discharge air substantially horizontally into the space adjacent the wall. A second blower is provided for exhausting air and impurities from the hood. An exhaust plenum is provided between the hood and the second blower. One or more filters are positioned opposite the first perforated wall between the same and the exhaust plenum for filtering air being drawn out of the hood. Exhausting the ambient air from the vicinity of the device, such as a cooking grill, deep fat fryer and the like, over which the hood is placed is reduced and the energy efficiency of the ventilating system improved.

In a particularly preferred variant of the invention, at least one opening, preferably in the form of one or more slits, is provided into the exhaust plenum, this at least one opening being adjacent a top portion of the second perforated wall so as to provide fluid communication from the space immediately adjacent the second perforated wall and the exhaust plenum, a space in which air and airborne impurities as well as flue gases, if present, are expecially hot and can thus be cooled effectively by the untempered, makeup air exiting the apertures in the second perforated wall.

In a preferred variant, a wall of the exhaust plenum has its external surface inclined upwardly in a rearward direction toward the at least one opening so as to direct material, air and airborne material, as well as flue gas, if present, toward the at least one opening.

The ventilating system having that at least one opening mentioned above preferably includes within the exhaust plenum, a baffle which swirls the air and airborne impurites, as well as flue gas, if present, in such a fashion to assure that cooling takes place and grease, fat and the like which may be carried deposits on portions of the baffle and drained downwardly so that it may be suitably removed, possibly by a trough or the like, instead of depositing on interior surfaces of the exhaust system.

The invention may further include a novel ventilating system in operative association with a device which produces airborne impurities, such as a cooking grill, deep fat fryer and the like, and in particular, such a device which includes an exhaust for flue gases positioned in the vicinity of the second perforated wall.

DETAILED DESCRIPTION OF PREFERRED EMBODIMENTS

Figure 1:
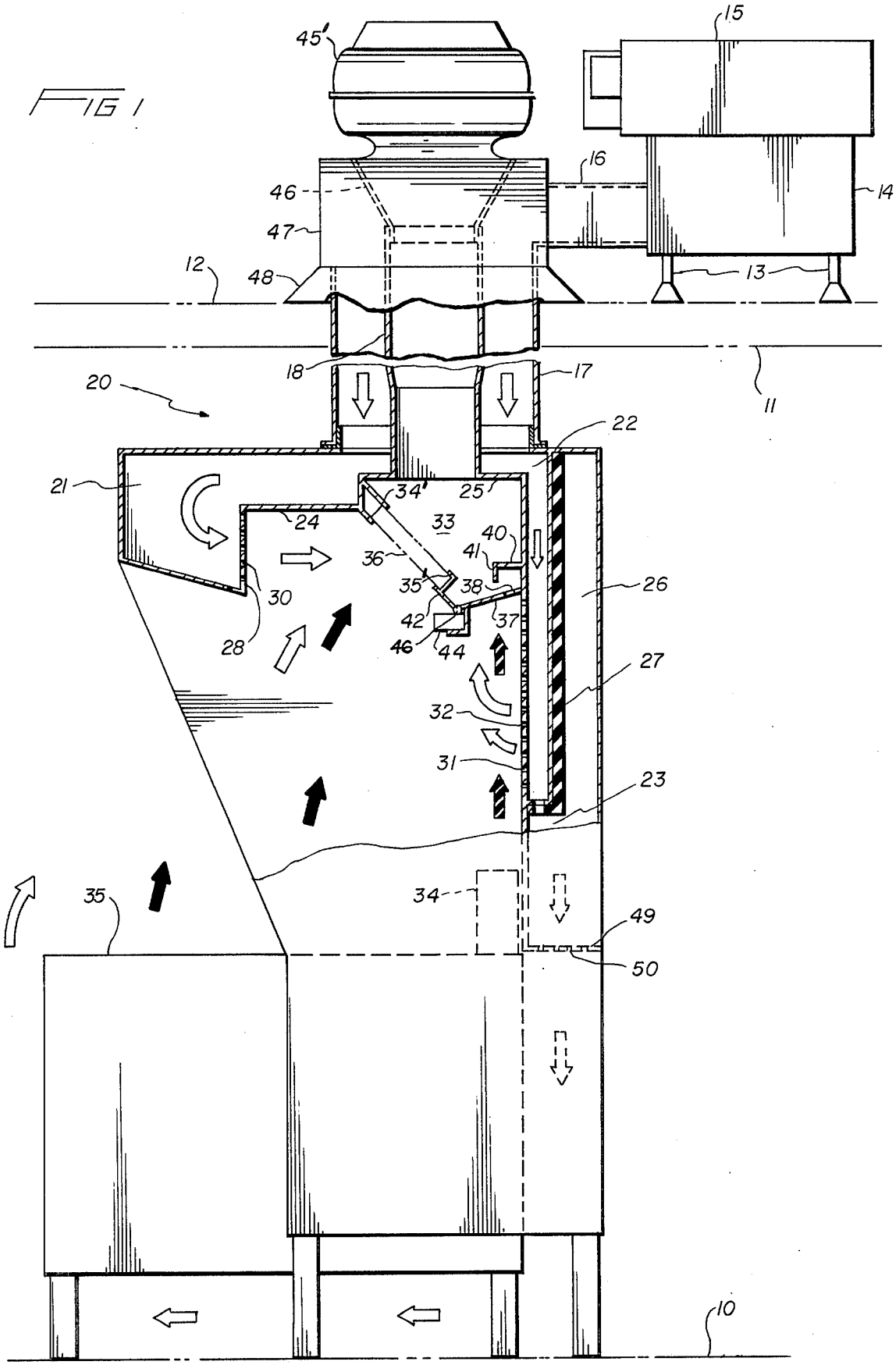
FIG. 1 is a side view, partially broken away and in section, of a ventilating system for use with a device which produces airborne impurities, in accordance with the present invention, in operative association with a cooking unit having an exhaust for flue gasses.
Figure 2:
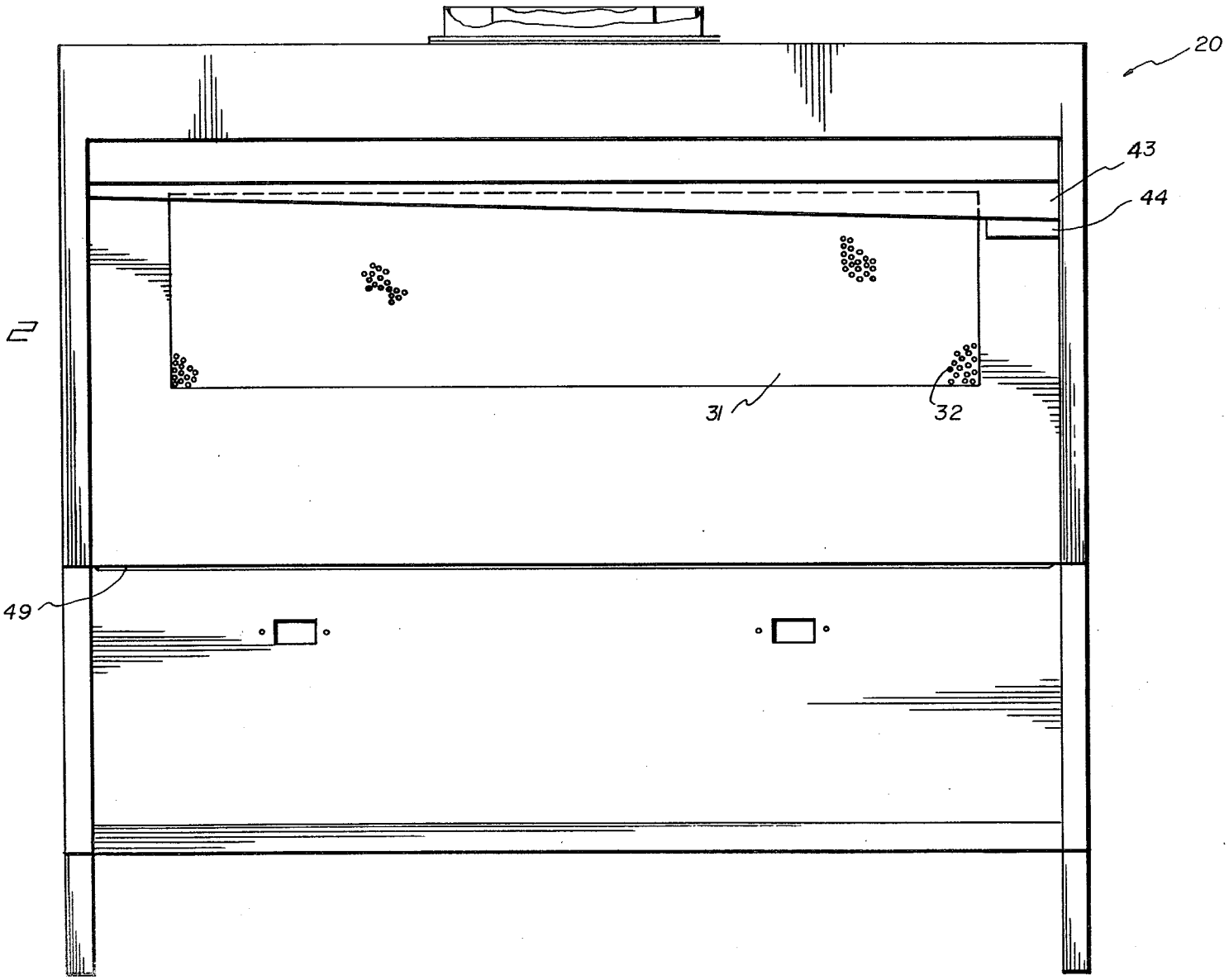
FIG. 2 is a front, elevational view of the hood portion of the ventilating system shown in FIG. 1.

Referring to FIGS. 1 and 2, an exemplary preferred embodiment of a ventilating system in accordance with the present invention is illustrated as being associated with premises such as a room which includes a floor 10 and a ceiling 11 designated diagramatically by respective chain lines. As shown, the ceiling 11 is part of a roof structure 12 also designated by a chain line. A plurality of equipment supports 13 are positioned on the roof 12 so as to support a makeup air duct 14 which itself supports an intake fan its housing 15 being visible in FIG. 1. The makeup air duct 14 is in fluid communication with a further air duct 16 which extends horizontally and communicates with a vertically descending makeup air duct 17, which surrounds and is substantially coaxial with an ascending exhaust duct 18.

The descending makeup air duct 17 supplies untempered, makeup air to the interior of a hood 20 which includes a first plenum 21 defining a front makeup air chamber, a second plenum 22 which defines a rear makeup chamber and a third plenum 23 which defines a makeup air chamber adapted to replace at least some of the ambient air exhausted from the premises. The makeup air duct 17 is in fluid communication with the plenum 21 via an air duct 24, is in fluid communication with the plenum 22 via an air duct 25 and in fluid communication with the plenum 23 via the air duct 25 and the plenum 22. The interior rear wall of the plenum 22 is provided with insulation 27 so as to aid in maintaining the makeup air within the plenum 22 at its initial, relatively low temperature. A chamber 26 extends upwardly from the plenum 23.

The plenum 21 is provided with a vertically extending, inwardly facing perforated wall 28, the perforations being provided by a plurality of apertures 30 extending through the wall 28. Makeup air exits from the plenum 21 via the apertures 30 in the perforated wall 28. The plenum 22 includes an inwardly facing perforated wall 31 which is provided over a considerable surface area with a plurality of apertures 32 which may extend between a bottom wall of an exhaust plenum 33 to just above the top of flue exhaust duct 34 positioned adjacent the wall 31 and extending upwardly from a cooking unit 35. In the event that the exhaust duct 34 for flue gas is not required, the perforations in the wall 31 may be provided over virtually the entire area of the wall 31 which defines the rearward wall of the hood 20 from the cooking surface of the unit 35 up to the junction of a lower wall of the exhaust plenum 33 with the wall 31. Exhaust plenum 33 is provided with brackets 34',35' positioned so as to hold one or more air filters 36 in an inclined position in respect to the vertical, the filter or filters 36 being positioned opposite the perforated wall 28 of the plenum 21. The bottom of the exhaust plenum 33 is defined by an inclined, upwardly extending wall member 37 which is provided with at least one aperture 38 in the form of a slit therein, its periphery being preferably bent upward to prevent grease or fat from flowing out from the exhaust plenum 33. Rather, such grease or fat flows into an included trough 43 along the interior of the wall member 37. Opposite the slit 38 within the plenum 33 is positioned a fixed baffle 40 having a downwardly extending arm 41. The slanted wall member 37 is operatively arranged with a further wall member 42 so as to define the inclined trough 43. The inclined trough 43 is positioned so as to collect grease, fat and the like removed from the exhausting air by the filter or filters 36 and which collects on the baffle 40 and, because of its inclined nature, allows the thus collected grease, fat and the like to flow into a bracket supported removeable sump 44, via an orifice 45 in the apex of the wall members 37,42.

The exhaust duct 18 provides fluid communication between the exhaust plenum 33 and an exhaust fan 45' via an exhaust transition duct 46 which extends downwardly from the exhaust fan 45' within an exhaust housing base 47 which is positioned on a roof curb 48.

The plenum 23 has a horizontally extending bottom wall 49 which is provided with a plurality of apertures 50 for the purpose of directing uptempered, makeup air towards the floor 10 so as to replenish some of the air exhausted from the premises and to provide untempered makeup air which flows beneath the cooking unit 35 upwardly along its front and thence into the hood 20 as a result of the suction provided by the exhaust fan 45'.

Let it be assumed that the device which produces airborne impurities is a cooking unit which produces entrained fat or grease particles and heats the air over its cooking units or surfaces to high temperatures. The hot air, with the entrained fat or grease particles, rises from the upper portions of the cooking unit 35 within the hood 20, this hot air with its entrained particles being illustrated diagramatically by upward pointing black arrows in FIG. 1. Spent, hot flue gases escape via the exhaust duct 34 from the cooking unit 35 and tend to move upwardly along the rear wall 31 of the hood 20, this extremely hot flue gas being illustrated diagramatically by the upward extending striped arrows in FIG. 1.

The intake fan 15, which has a slightly less capacity than the exhaust fan 45', ingests untempered, makeup air from the exterior of the premises within which the cooking unit 35 is placed. This untempered, makeup air is supplied to the interior of the hood 20 via intake air ducts 14,16 and 17, the untempered, makeup air being diagramatically illustrated by white arrows, the white arrows within the duct 17 being shown in a downward facing direction. Portions of the ingested, untempered makeup air is delivered from the duct 17, via the duct 24, to the plenum 21. The untempered, makeup air so supplied exits from the plenum 21 via the apertures 30 and the wall 28 in the general direction of the filter or filters 36, the untempered, makeup air mixes with the hot air rising from the surface of the cooking unit 35 and serves to cool the hot air and its hot entrained grease or fat content.

Some of the ingested, untempered, makeup air exits from the plenum 23 through the apertures 50 in its downwardly facing wall 49, again as indicated by the white arrows, at least some of the air so exiting from the apertures 50 moves beneath the cooking unit 35, upwardly along its front surface and thence into the hood 20 where this additional untempered, makeup air, as well as some ambient air from the premises in which the cooking unit 35 is located, moves upwardly within the hood 20 providing additional cooling to the hot air and its entrained grease and fat particles as the hot air with these entrained particles rise within the hood 20 in the direction of the filter or filters 36. Still additional untempered, makeup air exits from the plenum 22, via the apertures 32 appearing in the wall 31 and together with the makeup air from the plenums 21 and 23 cool the hot air with its entrained grease, fat and other impurities that are present, as this hot air with the entrained impurities rises toward the filter or filters 36.

The filter or filters 36 which are of known, conventional construction, remove at least considerable portions of the grease and fat, this material flowing downward into the trough 34 and thence into the removeable sump.

Some of the hot air from the surface of the cooking unit 35 with its entrained impurities which may include fat or grease tend to rise in the back portion of the hood and move upwardly in the vicinity of the perforated wall 31 in which this portion of the rising material with the flue gas from the exhaust duct 34 which, because of the high temperature of the flue gas, remain at a relatively high temperature. These materials rising in the vicinity of the perforated wall 31 are cooled to a considerable degree by the untempered, air exiting from the wall 31. The flue gas and the impurity ladened air, now cooled, enters the exhaust plenum 33 via the slit or slits 38, coming into contact with the baffle 41. The material is swirled by the baffle 40, moving along the surface of the downward extending portion 41 of the baffle 40, with the result that the grease or fat which may be entrained in the air and flue gases tends to collect on the arm 41, running down the arm 41 and dropping on the slanting inner surface of the wall member 37, flowing down this wall into the sump 44 via the inclined trough 43 and the aperture 45 which is present at the apex of the wall member 37 with the wall member 40. Thus the hottest of the entrained fat or grease particles do not pass needlessly through the filter or filters 36 nor do large amount of the very hot spent flue gases, if present, pass through the filter or filters 36 which would undesireably heat the filters to such a high temperature that they would be less efficient in removing the entrained fat or grease.

The air and flue gases which collect in the exhaust plenum 33, with most of the entrained fat and grease removed, is exhausted by the exhaust fan 45' from the exhaust plenum 33, via the exhaust duct 18 and transition duct 46, to the exterior of the premises in which the cooking unit 35 is located. Approximately eighty-five percent of the air which is exhausted by the exhaust fan 45' is supplied by the intake fan 15, only about fifteen percent of the exhausted air being supplied from the ambient, tempered air from within the premises in which the cooking unit is located.

The foregoing description and the accompanying illustrations relate to an embodiment of a ventilating system constructed in accordance with the present invention and given not by way of limitation, but by way of example. It is to be understood that numerous other embodiments and variants are possible without departing from the spirit and scope of the invention, its scope being defined in the appended claims.

What is claimed is:

1. A ventilation system for use with a device which produces airborne impurities, such as a cooking grill, deep fat fryer and the like, the device having a horizontal plane defining a cooking area directly below which the grill, fryer or the like is disposed, the system comprising, a hood which is to be disposed over the device which produces airborne impurities;

first blower means for supplying untempered makeup air;

first plenum means, including a first perforated wall having a plurality of openings therein, in communication with said first blower means and defining a first makeup air chamber for discharging untempered air into space beneath an upper front portion of said hood;

second plenum means, including a second perforated vertical wall substantially perpendicular to the horizontal cooking area having a plurality of apertures therein, in communication with said first blower means and defining a second makeup air chamber for discharging untempered air into space beneath a back portion of said hood, and to cool air and impurities moving upwardly in an open space adjacent said second perforated wall, said apertures being positioned to discharge air substantially horizontally in the open space adjacent said second perforated wall and parallel the cooking area, said vertical wall and its associated said apertures discharges air into a free space directly above the cooking grill, deep fat fryer or the like which air is unimpeded or diverted by contact with any other surface so as to provide a mass of relatively slow moving air which reduces the temperature of the gases and impurities substantially;

second blower means for exhausting air and impurities from said hood;

an exhaust plenum in communication with said second blower means;

filter means positioned opposite said first perforated wall between same and said exhaust plenum for filtering air being drawn out of said hood; and further comprising means including a member having at least one opening therein adjacent said filter means and forming at least a portion of a wall of said exhaust plenum, adjacent a top portion of said second perforated wall for providing communication from said space adjacent said second perforated wall and said exhaust plenum;

wherein exhausting of ambient air from the vicinity of the device over which the hood is to be placed is reduced, energy efficiency is improved and improved trapping of impurities is effected in said filter means while reducing the temperature of exhaust gases substantially.

2. A ventilation system according to claim 1, wherein said wall of said exhaust plenum has its external surface inclined upwardly in a rearward direction toward said at least one opening in said member so as to direct material toward said at least one opening.

3. A ventilation system according to claim 1 or 2, including baffle means opposite said at least one opening within said exhaust plenum.

4. A ventilation system according to claim 1 or 2, wherein said at least one opening is at least one slit.

5. A ventilation system according to claim 4, in combination with a device having a exhaust for flue gases positioned in vicinity of said second perforated wall so that flue gases pass along said second perforated wall through open space in front thereof and thence through said at least one slit.

6. A ventilation system according to claim 1 or 2, in combination with a device having a exhaust for flue gases positioned in vicinity of said second perforated wall so that flue gases pass along said second perforated wall, through open space in front thereof and thence through said at least one opening.

7. A ventilation system according to claim 1, including third plenum means in communication with said first blower means for discharging untempered air into space in vicinity of space into which a device which produces airborne impurties is to be placed beneath said hood.

* * * * *